US008181482B2

(12) United States Patent
Hasenfeld

(10) Patent No.: US 8,181,482 B2
(45) Date of Patent: May 22, 2012

(54) CUT GEMSTONE EXHIBITING EXCELLENT OPTICAL BRILLIANCE

(75) Inventor: Hertz Hasenfeld, Brooklyn, NY (US)

(73) Assignee: Hasenfeld-Stein, Inc., New York, NY (US)

( * ) Notice: Subject to any disclaimer, the term of this patent is extended or adjusted under 35 U.S.C. 154(b) by 438 days.

(21) Appl. No.: 12/357,666

(22) Filed: Jan. 22, 2009

(65) Prior Publication Data

US 2009/0183525 A1 Jul. 23, 2009

Related U.S. Application Data

(60) Provisional application No. 61/022,642, filed on Jan. 22, 2008.

(51) Int. Cl.
*A44C 17/00* (2006.01)

(52) U.S. Cl. ..... 63/32; D11/89

(58) Field of Classification Search ..... 63/32; D11/89
See application file for complete search history.

(56) References Cited

U.S. PATENT DOCUMENTS

| | | | | |
|---|---|---|---|---|
| 2,265,316 | A * | 12/1941 | Schenck | 63/32 |
| 3,875,760 | A | 4/1975 | Jones | |
| 4,118,950 | A | 10/1978 | Grossbard | |
| D324,003 | S * | 2/1992 | Baranes | D11/90 |
| D402,582 | S * | 12/1998 | Ambar | D11/89 |
| 6,818,280 | B2 * | 11/2004 | Matsumura et al. | 428/156 |
| D588,039 | S * | 3/2009 | Renner | D11/89 |
| 2003/0010058 | A1 * | 1/2003 | Wueste | 63/32 |
| 2004/0086691 | A1 | 5/2004 | Matsumura et al. | |

OTHER PUBLICATIONS

Howard B. Rockman; "Obtaining U.S. Copyright Registration for the Elara Square Cut-Cornered Brilliant Diamond"; Notes and New Techniques, Gems & Gemology, Fall 2003, pp. 210-213.

* cited by examiner

*Primary Examiner* — Jack W. Lavinder
*Assistant Examiner* — Emily Morgan
(74) *Attorney, Agent, or Firm* — Dickstein Shapiro LLP

(57) ABSTRACT

A gemstone including a substantially rectangular girdle, a crown extending in a first direction from the girdle, and a pavilion extending in a second direction from the girdle opposite the first direction. The gemstone has 65 uniquely arranged and angled facets, 25 of which are in the crown, and 40 of which are in the pavilion. The height of the crown is preferably between 9½ to 13½% of the width of the stone, the total depth of the stone is preferably between 63-70.9% of the width of the stone, and the width of the table is preferably between 60-68% of the width of the stone. The crown has four sides, a table, and four bezel facets each positioned at a respective corner of the crown. Each of the four sides of the crown have a first break extending from the girdle toward the table, a second break extending from the first break toward the table, a third break extending from the second break to the table, and a pair of star facets provided between the third break and the bezel facets at each corner of respective side of the crown. Preferably, and relative to a plane parallel to a surface of the table, the first break is cut at an angle of approximately 35-45°, the second break is cut at an angle of approximately 30-40°, the third break is cut at an angle of approximately 25-35°, and the bezel facets are cut at an angle of approximately 20-30°.

7 Claims, 4 Drawing Sheets

CUT GEMSTONE EXHIBITING EXCELLENT OPTICAL BRILLIANCE

CROSS-REFERENCE TO RELATED APPLICATIONS

The present application claims priority to provisional application Ser. No. 61/022,642, filed Jan. 22, 2008. The entire contents of which are incorporated herein by reference.

FIELD OF THE INVENTION

The present invention relates to cut gemstones exhibiting excellent optical brilliance and method for manufacturing the same. In particular, the present invention relates to a Princess cut diamond with superior optical characteristics compared to that of industry standard Princess cut diamonds, and the method by which such diamond is cut.

BACKGROUND OF THE INVENTION

The Princess cut diamond is the second most popular cut shape for diamonds, next to the Round Brilliant cut diamond. The top of the Princess cut diamond is cut in a square or rectangular shape, and the overall shape is similar to that of an inverted pyramid with four beveled sides. The Princess cut diamond is a relatively new diamond cut, having been created in the 1970s. The Princess cut diamond has gained in popularity in recent years as a more distinctive alternative to the traditional Round Brilliant cut, in which the top of diamond, called the crown, is cut in a round circle and the bottom, called the pavilion, forms a point like a cone.

One of the main characteristics of a diamond is light performance. The higher the light performance grade, the greater the brilliance and fire of the diamond. Light performance is impacted by, among other things, the number, shape, angles and arrangement of the facets on the cut diamond. Typical Princess diamonds contain from 49 to 61 facets. However, even with this number of facets, compared to Round Brilliant cut diamonds, typical Princess cut diamonds available to consumers lack both fire (colored light) and brilliance (white light).

In addition, the Princess cut diamond is usually less expensive than a Round Brilliant cut diamond of the same carat weight because it retains about 80% of the original rough diamond, as opposed to the Round Brilliant cut diamond which retains only about 50% of the rough diamond. The ability to retain more crystal weight makes the Princess cut diamond popular amongst diamond cutters.

SUMMARY OF THE INVENTION

It is an object of the present invention to enhance the brilliance of Princess cut diamonds so they rival the brilliance and light performance of Ideal Cut Round Brilliant diamonds.

The Princess cut diamond of the present invention includes a substantially rectangular girdle; a crown extending in a first direction from the girdle; and a pavilion extending in a second direction from the girdle opposite the first direction. The Princess cut diamond has 65 uniquely arranged and angled facets, 25 of which are in the crown, and 40 of which are in the pavilion. The height of the crown is preferably between 9½ to 13½% of the width of the stone, the total depth of the stone is preferably between 63-70.9% of the width of the stone, and the width of the table is preferably between 60-68% of the width of the stone.

The crown has four sides, a table, and four bezel facets each positioned at a respective corner of the crown. Each of the four sides of the crown have a first break extending from the girdle toward the table, a second break extending from the first break toward the table, a third break extending from the second break to the table, and a pair of star facets provided between the third break and the bezel facets at each corner of respective side of the crown.

In the preferred embodiment, the first break is cut at an angle of approximately 35-45°, the second break is cut at an angle of approximately 30-40°, the third break is cut at an angle of approximately 25-35°, and the bezel facets are cut at an angle of approximately 20-30°. All of these angles are relative to a plane parallel to the surface of the table.

The forty facets of the pavilion include four pavilion facets on each respective side of the gemstone, a main facet between each of the four pavilion facets; and four chevron facets between each main facet and each pavilion facet. Preferably, the four pavilion facets are each at an angle of approximately 53-65° relative to a plane parallel to the face of the girdle, and the main facets are each at an angle of approximately 35-39° relative to a plane parallel to the face of the girdle.

In a further embodiment, the corners of the girdle are chamfered to a degree that does not affect the brilliance of the gemstone and such that the chamfered corners are not perceptible with the human eye from a distance of at least 10 inches. Accordingly, it is preferred that the corners are chamfered to a degree that does not result in a notation in any written certification of the stone.

The present invention's unique combination of angles and faceting creates exceptional fire and brilliance. Specifically, the present invention uses unique faceting and angles that achieve an average 94% ("Excellent") light performance, as per the Gem Certification $ Assurance Lab (GCAL). Unlike standard Princess cut diamonds that use the industry standard 49 to 61 facets, the present invention uses a unique combination of 65 facets (25 in the crown, and 40 in the pavilion).

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

DETAILED DESCRIPTION OF THE INVENTION

The present invention will next be illustrated with reference to the figures. Such figures are intended to be illustrative rather than limiting and are included herewith to facilitate the explanation of exemplary features of embodiments of the present invention. Unless otherwise noted, the figures are not to scale, and are not intended to serve as engineering drawings.

Figure 1:
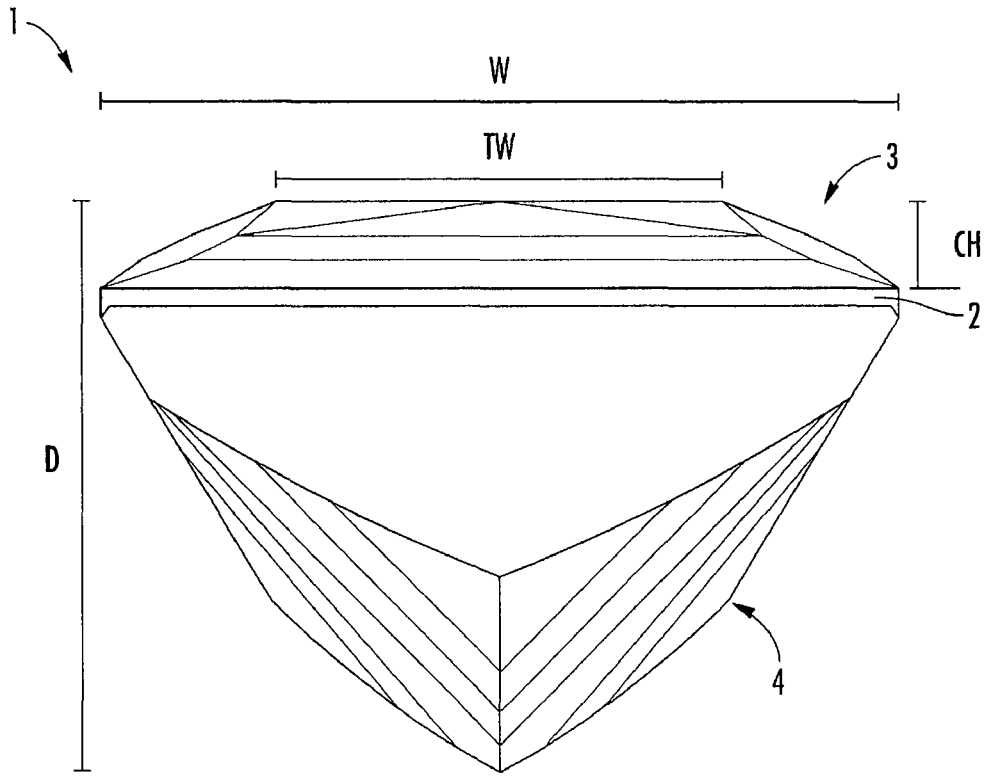
FIG. 1 is a side elevational view of a gemstone according to the present invention.

Referring now to the drawings, FIG. 1 is a side elevational view of a cut diamond 1 according to the present invention. Although the following description relates to a Princess cut diamond, it will be readily apparent to one of skill in the art that the unique angles and faceting described herein can be applied to any precious or semi-precious gemstone.

As shown in FIG. 1, the cut diamond 1 includes a substantially rectangular girdle 2, a crown 3 extending upward from the girdle 2, and a pavilion 4 extending downward from the girdle 2. It is preferred that the cut diamond 1 has a maximum length-to-width ratio of 1:1.05, and that the girdle thickness is from "thin to thick." The crown 3 has a height CH of approximately 9½ to 13½% of the width W of the stone (all percentages are based on the width W of the stone equaling 100%). The total depth D of the stone is approximately 63-70.9% of the width W of the stone.

Figure 2:
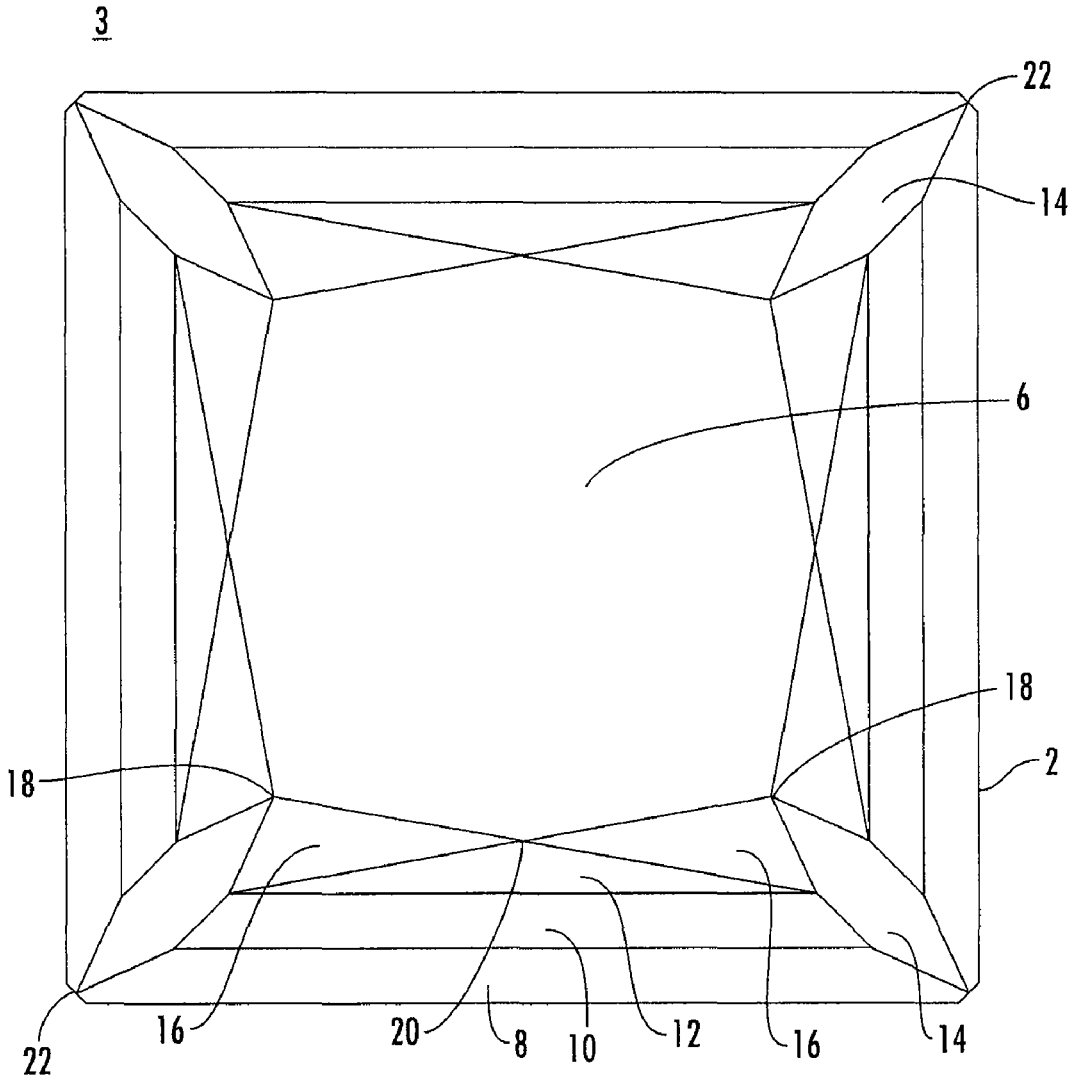
FIG. 2 is a top view of the gemstone shown in FIG. 1.

FIG. 2 is a top view showing the crown 3 of the cut diamond of FIG. 1. As shown in FIG. 2, the crown 3 includes 25 uniquely angled and arranged facets and breaks. These 25 facets/breaks include a table 6, a set of three breaks 8, 10, 12 along each respective side of the crown 3, four bezel facets 14 positioned at each respective corner of the crown 3, and a pair of star facets 16 provided between a top 18 of the bezel facets 14 and a top/middle 20 of the third break 12. As shown in FIG. 1, the table 6 has a width TW of between 60-68% of the width W of the stone.

Starting from the girdle 2, the crown 3 is divided into three separate breaks, 8, 10, and 12. The first break 8 is preferably cut at an angle of approximately 35-45° relative to a plane parallel to the surface of the table 6. The second break 10 is preferably cut at an angle of approximately 30-40° relative to a plane parallel to the surface of the table 6, and the third break 12 is preferably cut at an angle of approximately 25-35° relative to the plane parallel to the surface of the table 6.

The crown 3 also includes four bezel facets 14 at each corner of the crown. These bezel facets 14 are preferably cut at an angle of approximately 20-30° relative to the plane parallel to the surface of the table 6 (i.e., preferably 5° less than the third break 12).

A pair of star facets 16 are provided between a top 18 of each bezel facet 14 and the top/middle 20 of the third break 12. These star facets 16 are provided for symmetry to the crown and to achieve "excellent" light performance classification. The particular shape, dimensions and angle relative to the plane parallel to the surface of the table 6 of these star facets 16 will depend on the symmetry and dimensions of the stone being cut, and generally extend and cover the area from the center of the bezel facets 14 to the center of the table 6.

Given the above-described arrangement of all crown facets, and as shown in FIG. 2, each respective side of the crown 3 is defined and bordered by two respective bezel facets 14. The first break 8 is positioned between these two respective bezel facets 14 and extends from the girdle 2 toward the table 6. The second break 10 is also positioned between these two respective bezel facets 14 and extends from the first break 8 toward the table 6. The third break 12 is as well positioned between these two respective bezel facets 14 and extends from the second break 10 to the table 6. Further, each respective side of the crown 3 includes two of the star facets 16. A first of the star facets 16 is provided between a top 18 of one of the two respective bezel facets defining and bordering the side of the crown 3 and a top/middle 20 of the third break. Similarly, a second of the star facets 16 is provided between a top 18 of a second of the two respective bezel facets defining and bordering the side of the crown 3 and the top/middle 20 of the third break.

In addition, it is preferred that the corners 22 of the cut diamond are chamfered (shaved) to prevent chipping. These chamfered corners 22 are only cut slightly so as to not affect or alter the brilliance of the stone or the certification thereof. Preferably, the corners are chamfered such that the chamfered corners are not perceptible with the naked eye from a distance of at least 10 inches.

Figure 3:
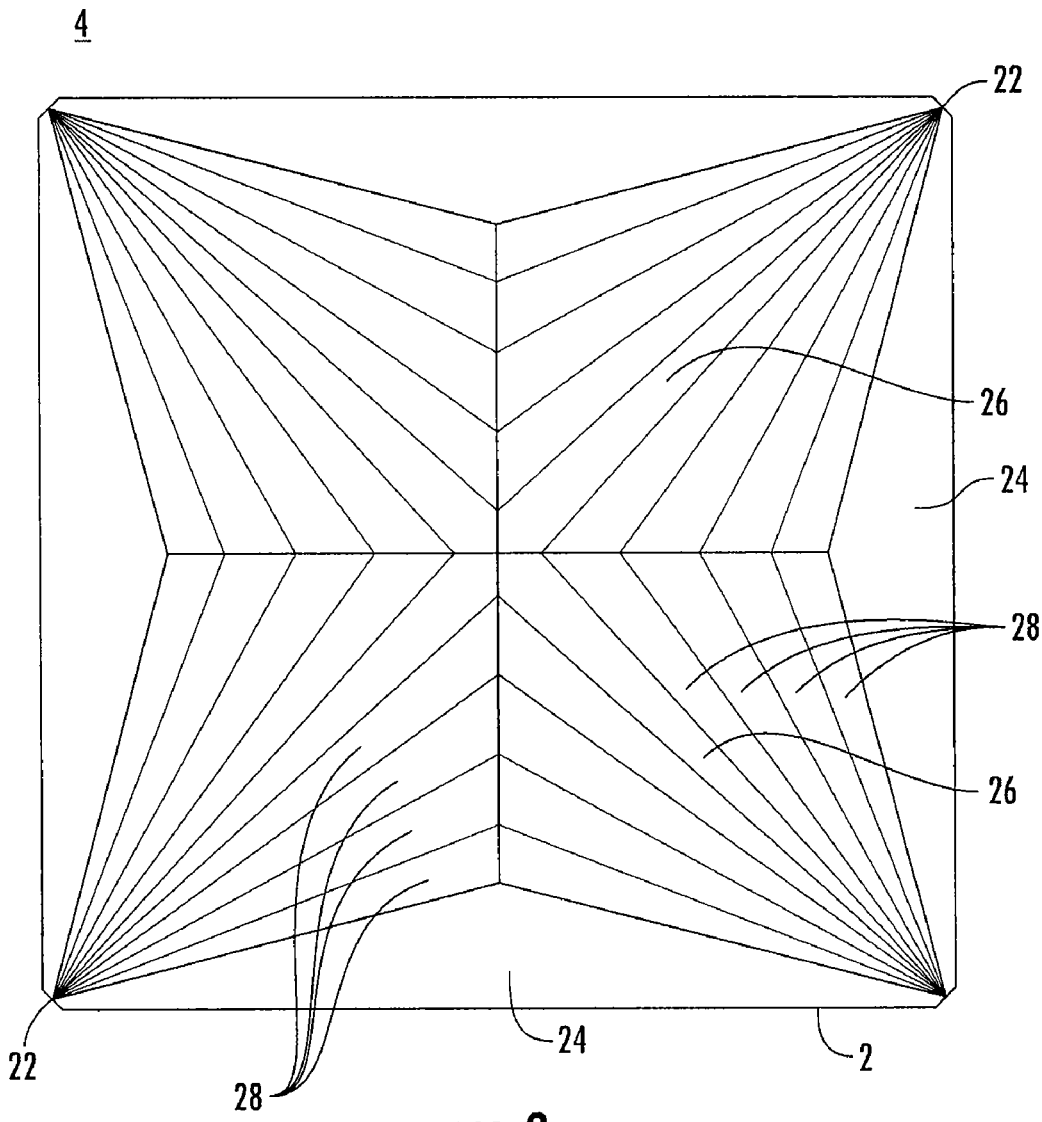
FIG. 3 is a bottom view of the gemstone of FIG. 1.

Turning now to FIG. 3, the pavilion 4 of the cut diamond 1 of FIG. 1 is shown. The pavilion 4 includes 40 uniquely angled and arranged facets. These 40 facets include four pavilion (or half moon) facets 24 on each respective side of the cut diamond 1. These pavilion facets 24 are preferably cut at an angle of approximately 53-65° relative to a plane parallel to a face of the girdle 2.

Between each of the four pavilion facets 24, there is provided a main bottom facet 26 (for a total of four (4) main bottom facets 26). These main bottom facets 26 are preferably cut at an angle of approximately 35-39° relative to the plane parallel to the face of the girdle 2.

Between each main bottom facet 26 and its respective pavilion facet 24, the diamond is equally divided by four (4) chevron facets 28 (for a total of 32 chevron facets). The particular shape, dimensions and angle relative to the plane parallel to the face of the girdle 2 of these chevron facets 28 will depend on the symmetry and dimensions of the particular stone being cut.

Figure 4:
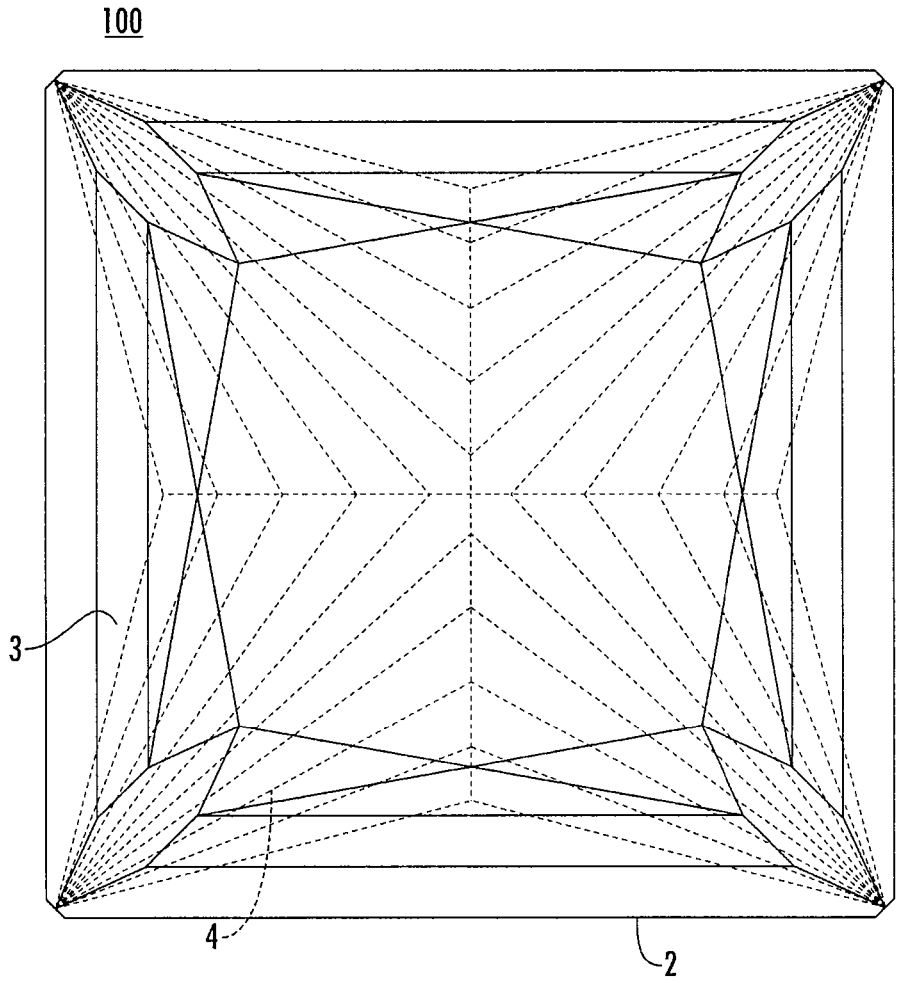
FIG. 4 is a top view of a translucent gemstone according to the present invention.

Referring now to FIG. 4, wherein like reference numerals represent like components, a top view of a translucent gemstone 100 according to the present invention is shown. In particular, FIG. 4 shows the unique interaction of the faceting of the crown 3 and the pavilion 4 when viewed through the crown of the translucent gemstone 100. The faceting of the crown 3 is shown in solid lines and the faceting of the pavilion 4 is shown in dashed lines.

The present invention's unique combination of angles and faceting creates exceptional fire and brilliance. Specifically, the present invention's use and arrangement of the unique faceting and angles achieves an average 94% ("Excellent") light performance, as per the Gem Certification $ Assurance Lab (GCAL). Accordingly, unlike standard Princess cut diamonds that use the industry standard 49 to 61 facets, the present invention uses a unique combination of 65 facets (25 in the crown, and 40 in the pavilion).

Although the present invention has been described in relation to particular embodiments thereof, many other variations and modifications will become apparent to those skilled in the art. Therefore, the present invention should not be limited by the specific disclosure herein, but only by the appended claims. For example, although the present invention has been described with respect to a cut diamond, the unique angles and faceting can be equally applied to all precious or semi-precious stones to achieve enhanced brilliance and light performance.

What is claimed is:

1. A gemstone comprising:

a substantially rectangular girdle;

a crown extending in a first direction from the girdle, the crown having a table, four sides, and four bezel facets each positioned at a respective corner of the crown, each of the four sides of the crown including:

a first break extending from the girdle toward the table;

a second break extending from the first break toward the table;

a third break extending from the second break to the table; and a first star facet provided between the third break and a first bezel facet of the four bezel facets; and a second star facet provided between the third break and a second bezel facet of the four bezel facets; and a pavilion extending in a second direction from the girdle, opposite the first direction, wherein a height of the crown is between 9 ½ to 13 ½% of a width of the gemstone, and wherein a width of the table is between 60-68% of the width of the gemstone, wherein the first break is at an angle of approximately 35-45° relative to a first plane parallel to a surface of the table, the second break is at an angle of approximately 30-40° relative to the first plane, the third break is at an angle of approximately 25-35° relative to the first plane, and the bezel facets are at an angle of approximately 20-30° relative to the first plane, wherein the pavilion includes a pavilion facet on each respective side of the gemstone, a main facet between each of the four pavilion facets, and four chevron facets between each main facet and each pavilion facet, wherein the four pavilion facets are each at an angle of approximately 53-65° relative to a second plane parallel to a face of the girdle, and wherein the main facets are each at an angle of approximately 35-39° relative to the second plane.

2. The gemstone according to claim 1, wherein the pair of star facets extend and cover an area from a center of the bezel facets to a center of the table.

3. The gemstone according to claim 1, wherein corners of the girdle are chamfered.

4. The gemstone according to claim 3, wherein the corners are chamfered to a degree that does not affect a brilliance of the gemstone.

5. The gemstone according to claim 3, wherein the corners are chamfered such that the chamfers are not perceptible with a human eye from a distance of at least 10 inches.

6. The gemstone according to claim 1, wherein the gemstone has a maximum length-to-width ratio of 1:1.05.

7. The gemstone according to claim 1, wherein a depth of the gemstone is between 63-70.9% of the width of the gemstone.

* * * * *